US008205648B2

(12) United States Patent
Hsu

(10) Patent No.: US 8,205,648 B2
(45) Date of Patent: Jun. 26, 2012

(54) ELECTRONIC PENCIL SHARPENER

(76) Inventor: Chia-Wen Hsu, Taichung Hsien (TW)

( * ) Notice: Subject to any disclaimer, the term of this patent is extended or adjusted under 35 U.S.C. 154(b) by 194 days.

(21) Appl. No.: 12/785,055

(22) Filed: May 21, 2010

(65) Prior Publication Data

US 2011/0284130 A1 Nov. 24, 2011

(51) Int. Cl.
*B43L 23/00* (2006.01)

(52) U.S. Cl. ..... 144/28.1; 144/28.3; 144/28.72

(58) Field of Classification Search ..... 144/28.1, 144/28.3, 28.4, 28.6, 28.7, 28.72
See application file for complete search history.

(56) References Cited

U.S. PATENT DOCUMENTS 5,394,613 A * 3/1995 Ku ..... 30/454
5,875,555 A * 3/1999 Andrisin et al. ..... 30/452
7,699,082 B2 * 4/2010 Peng ..... 144/28.4
2008/0142117 A1 * 6/2008 Peng ..... 144/28.72
2010/0175788 A1 * 7/2010 Yeh et al. ..... 144/28.72

* cited by examiner

*Primary Examiner* — Bena Miller

(57) ABSTRACT

An electric pencil sharpener includes a housing unit having an opening, a driving member driven by a motor, a cutting unit, and a panel unit. The cutting unit includes an outer frame mounted removably in the housing unit and including a ring gear, an inner frame disposed pivotally within the outer frame, and at least one cutting member disposed pivotally on the inner frame. The inner frame has a driven portion connected co-rotatably and removably to the driving member, and a cutting groove. The cutting member has a blade portion adjacent to the cutting groove, and a planetary gear portion meshing with the ring gear. The panel unit is mounted removably to the housing unit for covering the opening, and has a pencil-feeding hole. When the panel unit is removed from the housing unit, the cutting unit can be taken out of the housing unit through the opening.

9 Claims, 10 Drawing Sheets

ELECTRONIC PENCIL SHARPENER

BACKGROUND OF THE INVENTION

1. Field of the Invention

This invention relates to a pencil sharpener, and more particularly to an electric pencil sharpener.

2. Description of the Related Art

Referring to FIG. 1, a conventional electric pencil sharpener includes a housing 1 having a partition 101, a cutting device 2 disposed in the housing 1, and a driving device 3 disposed in the housing 1. The driving device 2 includes a carrier 201 connected rotatably to the partition 101, a ring gear 202 disposed on the partition 101, and a threaded cutter 203 disposed pivotally to the carrier 201. The threaded cutter 203 has a planetary gear portion 204 meshing with the ring gear 202. The driving device 3 includes a driving motor 301, a small gear 302 disposed on an output shaft of the driving motor 301, and a large gear 303 disposed on a rear end of the carrier 201 and behind the partition 101. Upon insertion of a pencil (not shown) into the carrier 201, the driving motor 301 is operated to rotate the carrier 201. Hence, the threaded cutter 203 is rotated about the rotating axis thereof and the center of the ring gear 202 to thereby cut the pencil.

However, since the rear end of the carrier 201 is connected to the large gear 202 at a position located behind the partition 101, it is difficult to remove the cutting device 2 from the housing 1. As a result, when the threaded cutter 203 becomes blunt, the cutting device 2 cannot be removed by the user for replacement of the threaded cutter 203, thereby resulting in inconvenience during use of the conventional electric pencil sharpener.

SUMMARY OF THE INVENTION

The object of this invention is to provide an electric pencil sharpener including a cutting unit that is easy to replace.

According to this invention, an electric pencil sharpener includes a housing unit having an opening, a driving member driven by a motor, a cutting unit, and a panel unit. The cutting unit includes an outer frame mounted removably in the housing unit and including a ring gear, an inner frame disposed pivotally within the outer frame, and at least one cutting member disposed pivotally on the inner frame. The inner frame has a driven portion connected co-rotatably and removably to the driving member, and a cutting groove. The cutting member has a blade portion adjacent to the cutting groove, and a planetary gear portion meshing with the ring gear. The panel unit is mounted removably to the housing unit for covering the opening, and has a pencil-feeding hole. When the panel unit is removed from the housing unit, the cutting unit can be taken out of the housing unit through the opening. As such, the cutting unit is easy to replace.

BRIEF DESCRIPTION OF THE DRAWINGS

These and other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
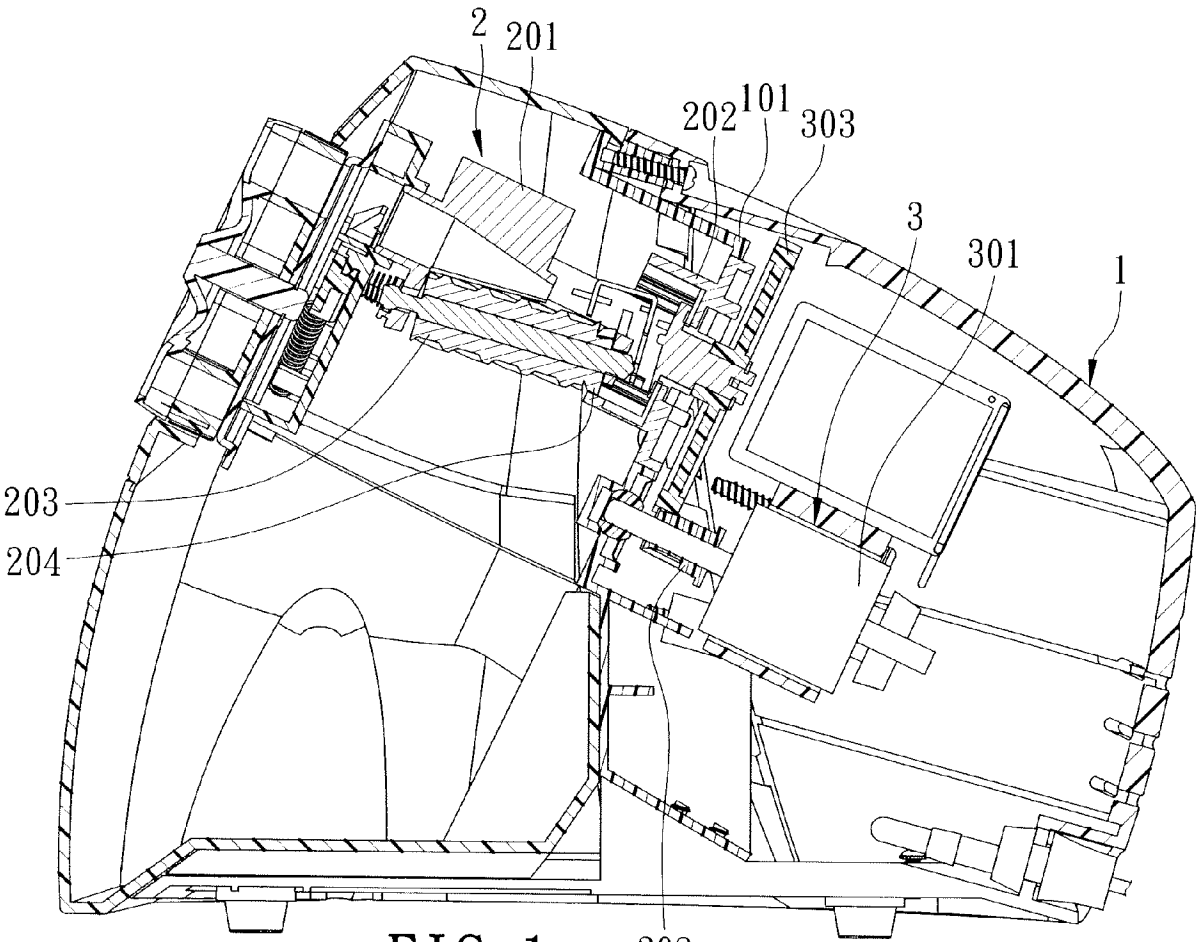
FIG. 1 PRIOR ART
FIG. 1 is a schematic sectional view of a conventional electric pencil sharpener.
Figure 2:
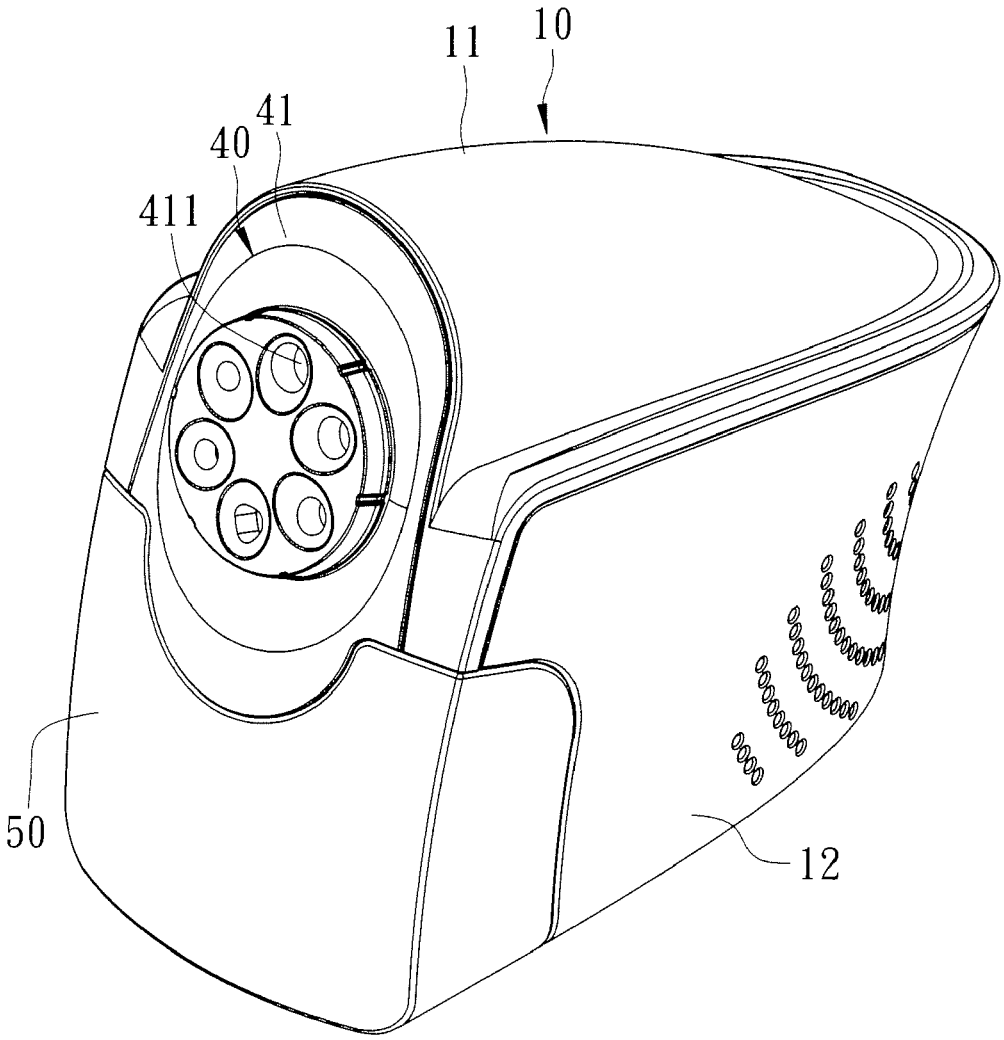
FIG. 2 is an assembled perspective view of the preferred embodiment of an electric pencil sharpener according to this invention.
Figure 3:
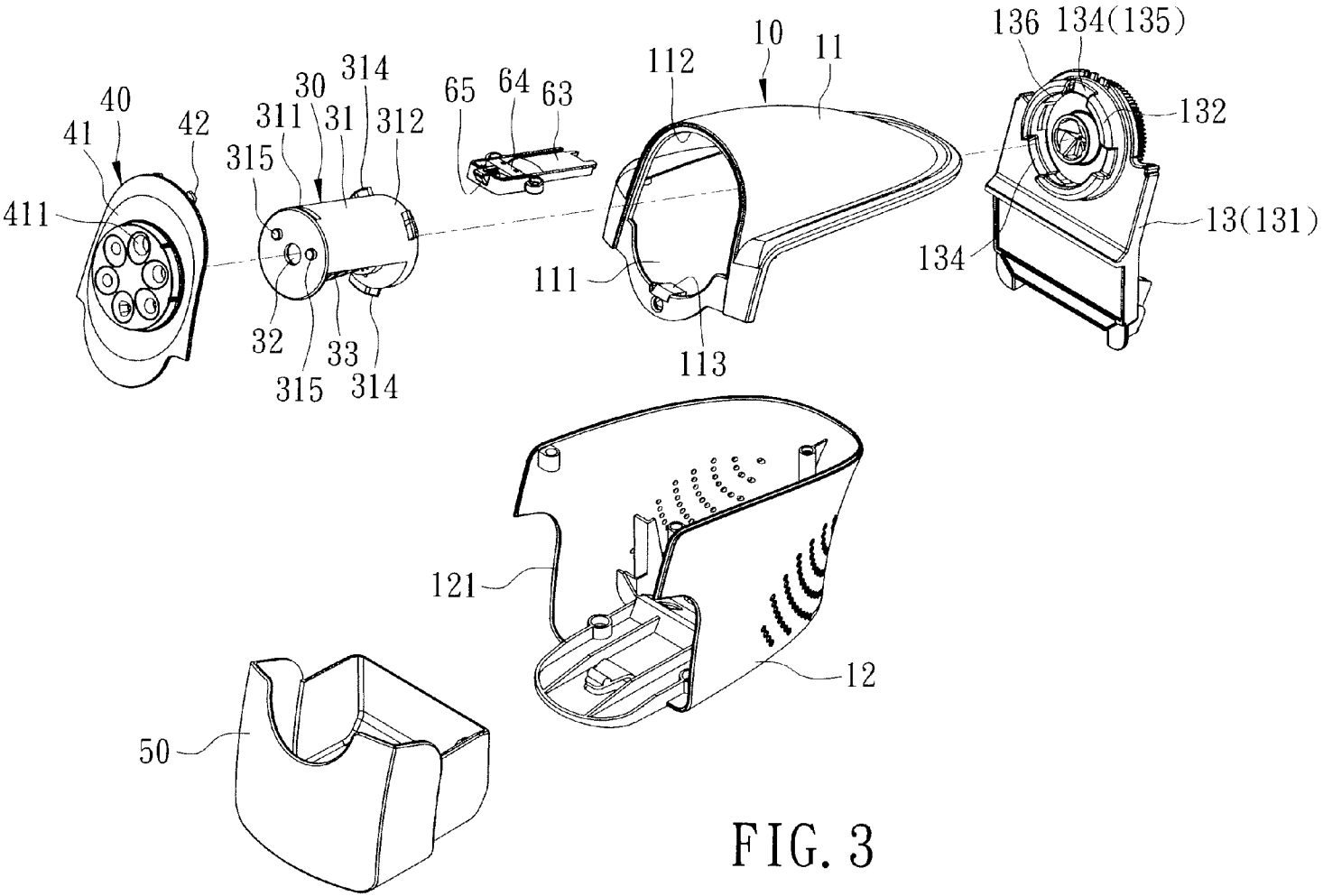
FIG. 3 is an exploded perspective view of the preferred embodiment.
Figure 4:
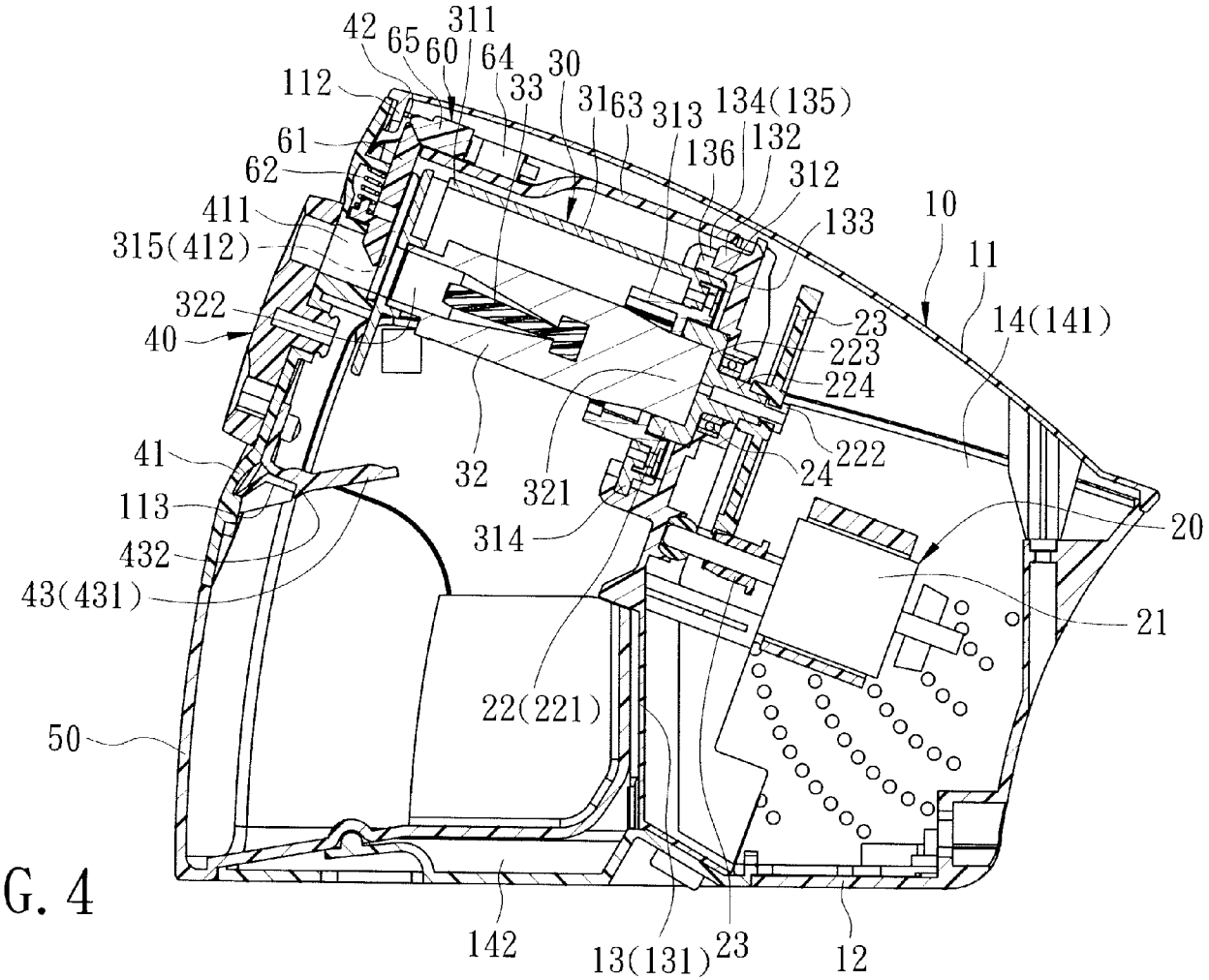
FIG. 4 is a schematic sectional view of the preferred embodiment.

Referring to FIGS. 2, 3, and 4, the preferred embodiment of an electric pencil sharpener according to this invention includes a housing unit 10, a driving unit 20, a cutting unit 30, a panel unit 40, a shaving-collecting container 50, and an activating unit 60.

The housing unit 10 includes an upper housing 11, a lower housing 12 disposed under and connected to the upper housing 11, and a partition 13 disposed on the lower housing 12. The upper and lower housings 11, 12 cooperate to define an accommodating space 14 therebetween. The partition 13 divides the accommodating space 14 into an equipment-receiving space portion 141 and a cutting space portion 142.

Figure 5:
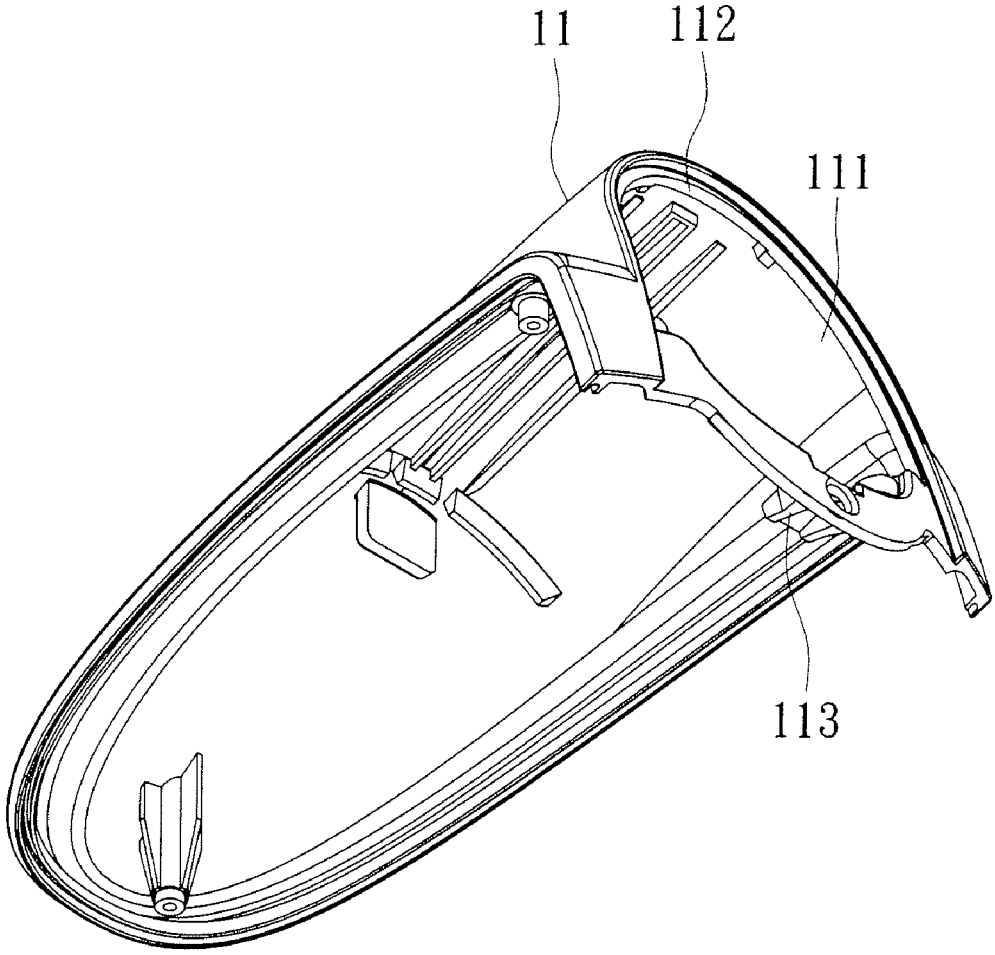
FIG. 5 is a perspective view of an upper housing of the preferred embodiment.

With additional reference to FIG. 5, the upper housing 11 has a first opening 111 formed at a front end portion thereof and in spatial communication with the cutting space portion 142, a flange 112 extending downwardly from a wall of the upper housing 11 defining a top end of the first opening 111, and a retaining block 113 disposed at a bottom end of the first opening 111 and extending rearwardly into the cutting space portion 142. The lower housing 12 has a second opening 121 disposed below the first opening 111.

Figure 6:
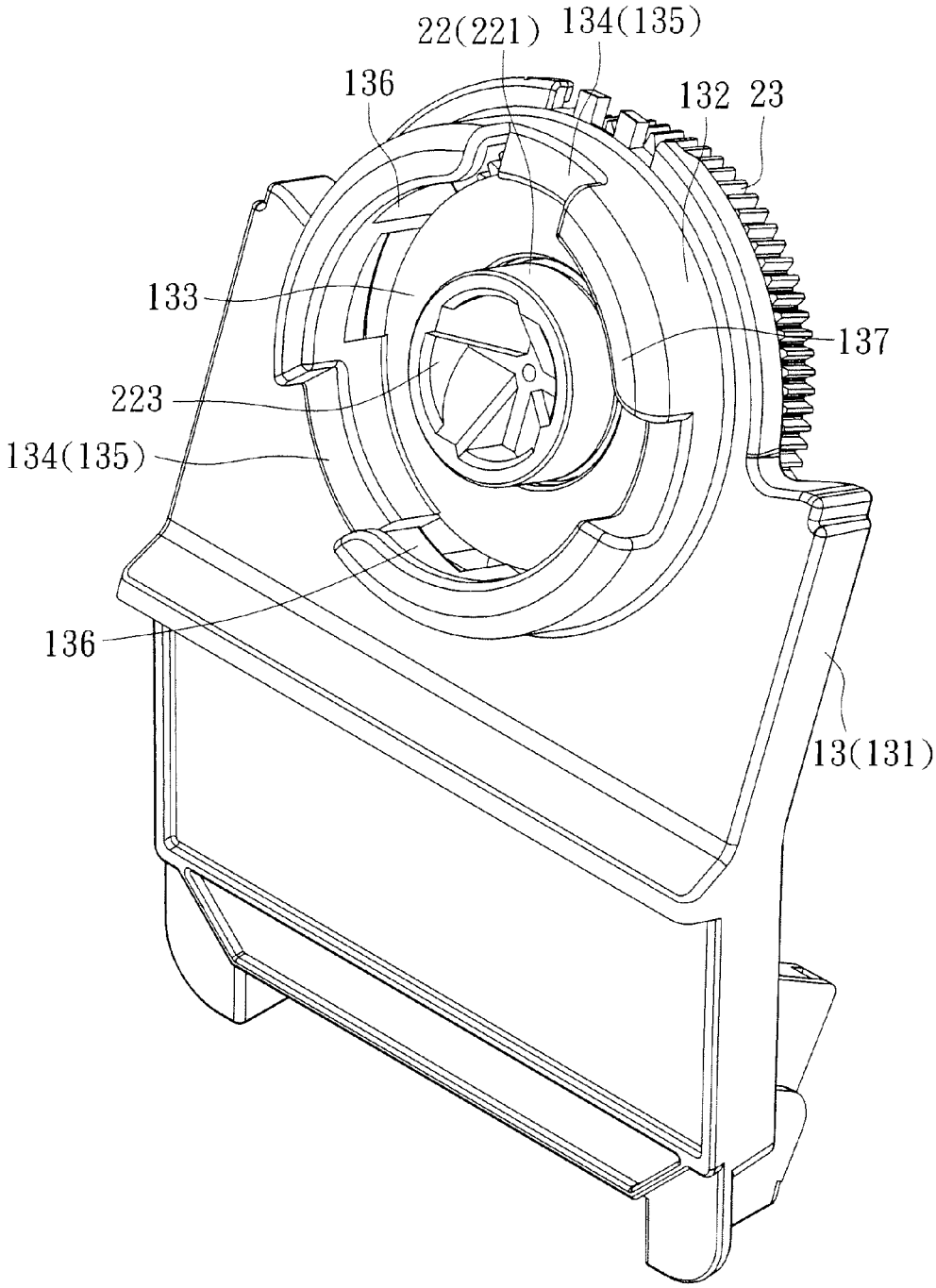
FIG. 6 is a perspective view of a partition and a driving member of the preferred embodiment.

With further reference to FIG. 6, the partition 13 has a plate body 131 and a loop-shaped wall 132 disposed on the plate body 131 to define a mounting hole 133. The loop-shaped wall 132 is formed with a plurality of spaced-apart retaining grooves 134 each having an axial portion 135 extending in an axial direction of the mounting hole 133, and a circumferential section 136 in spatial communication with the axial section 135 and extending in a circumferential direction of the mounting hole 133.

The driving unit 20 includes a driving motor 21 disposed in the equipment-receiving space portion 141, a driving member 22 disposed pivotally on the plate body 131 of the partition 13 and driven by the driving motor 21, a plurality of reduction gears 23, and a ball bearing 24.

The driving member 22 has a driving end 221 extending into the mounting hole 133, a driven end 222 opposite to the driving end 221, an engagement groove unit 223 formed in the driving end 221, and a connecting section 224 connected between the driving end 221 and the driven end 222.

The reduction gears 23 are disposed between the driven end 222 of the driving member 22 and an output shaft of the driving motor 21. The ball bearing 24 is disposed between the connecting section 224 and the plate body 131 of the partition 13.

Figure 7:
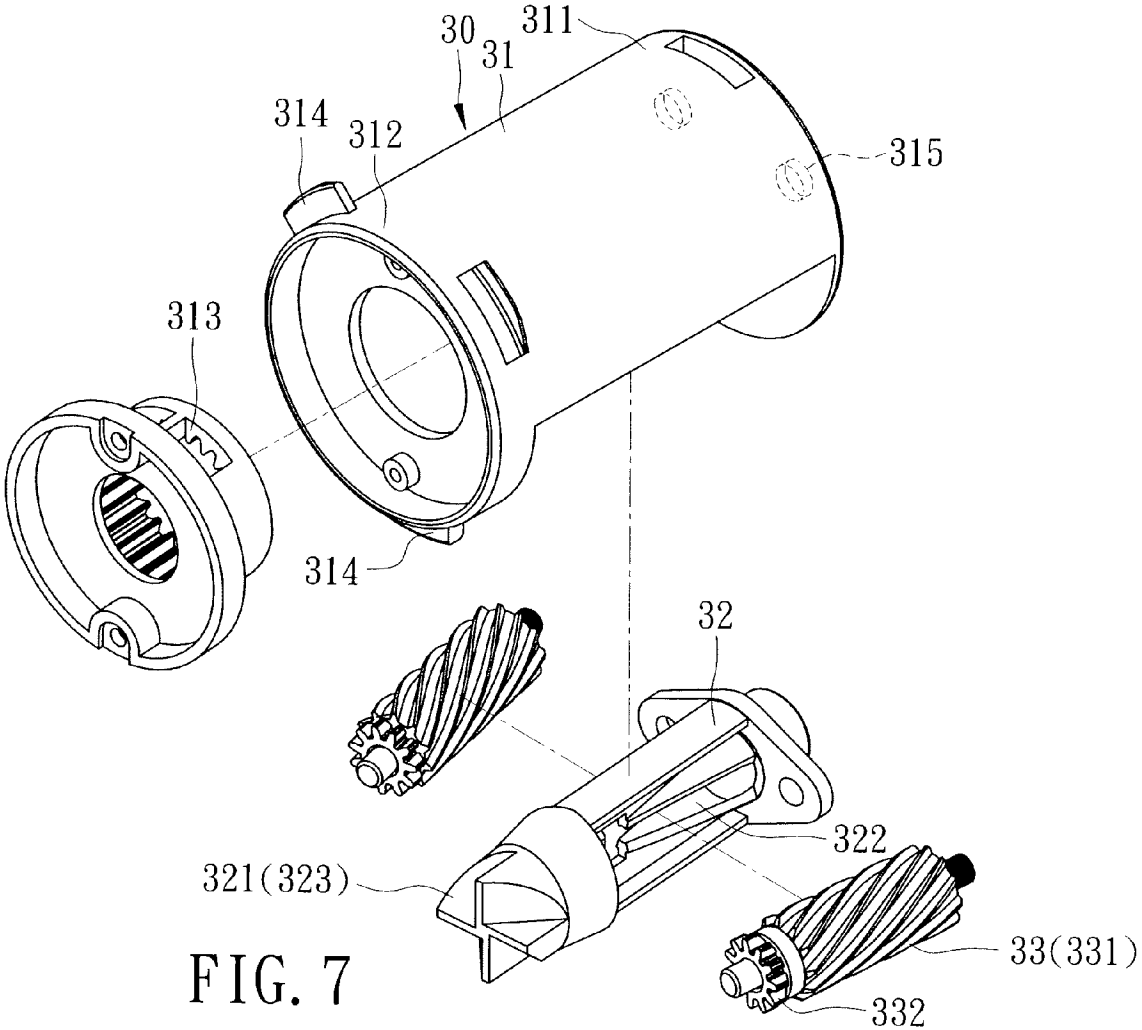
FIG. 7 is an exploded perspective view of a cutting unit of the preferred embodiment.

With further reference to FIG. 7, the cutting unit 30 is disposed within the cutting space portion 142, and includes an outer frame 31 mounted removably to the partition 13, an inner frame 32 disposed pivotally within the outer frame 31, and a plurality of cutting members 33 disposed pivotally on the inner frame 32.

The outer frame 31 includes a front end portion 311, a rear end portion 312 disposed within the mounting hole 133, a ring gear 313 disposed at the rear end portion 312, a plurality of spaced-apart positioning blocks 314 disposed on an outer periphery of the rear end portion 312, and a plurality of positioning stubs 315 extending forwardly from the front end portion 311.

The inner frame 32 has a driven portion 321 connected co-rotatably and removably to the driving member 22, and a cutting groove 322. The driven portion 321 has a plurality of engagement teeth 323 that engage the engagement groove unit 223 (see FIG. 6) so as to allow for co-rotation of the inner frame 32 with the driving member 22.

Each of the cutting members 33 has a blade portion 331 adjacent to the cutting groove 322, and a planetary gear portion 332 meshing with the ring gear 313.

Figure 8:
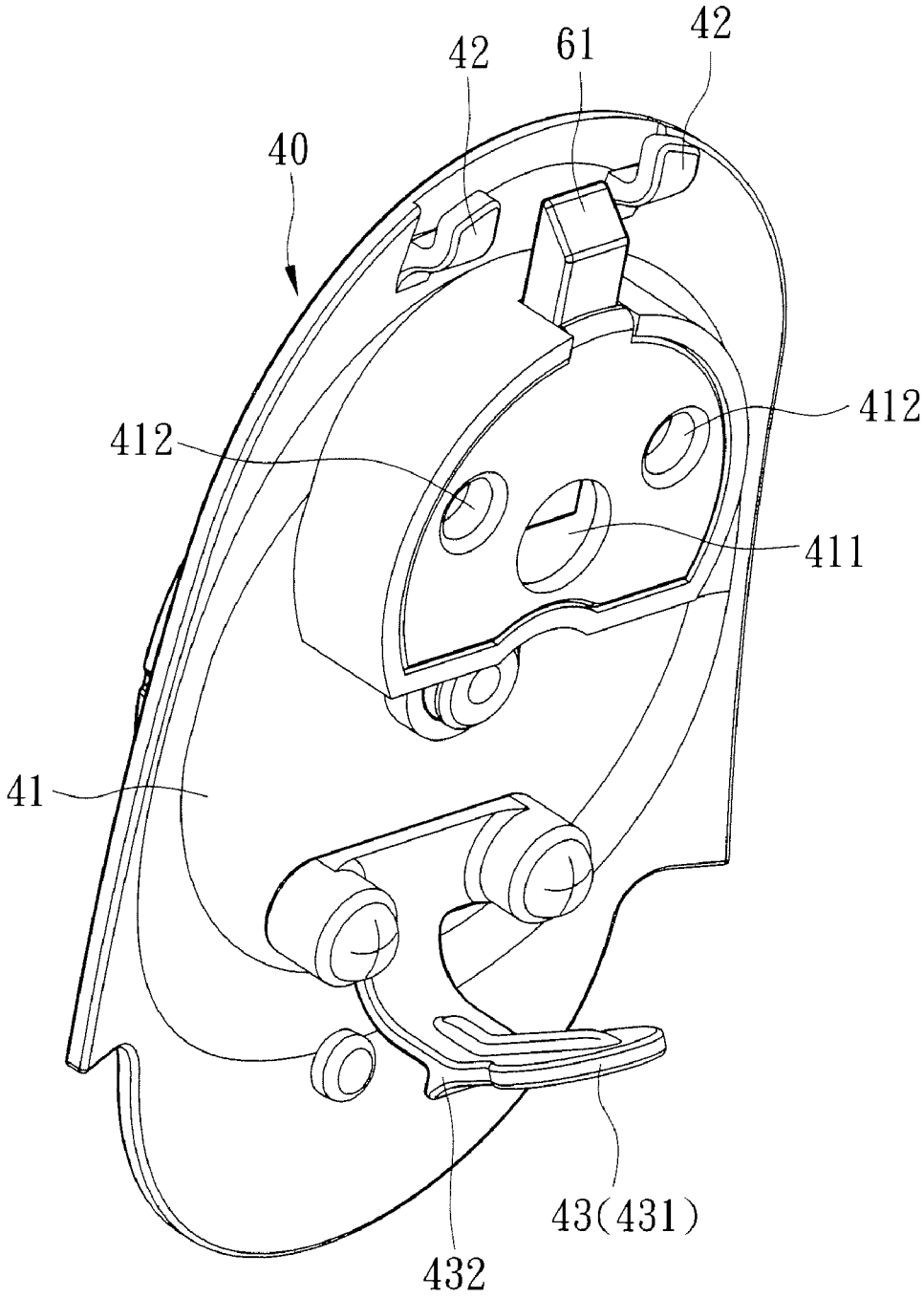
FIG. 8 is a perspective view of a panel unit of the preferred embodiment.

With further reference to FIG. 8, the panel unit 40 is mounted removably to the housing unit 10 for covering the first opening 133. The panel unit 40 has a panel body 41, a plurality of upper retaining hooks 42 extending rearwardly and upwardly from the panel body 41, and a resilient lower retaining hook 43 disposed below the upper retaining hooks 42 and extending rearwardly from the panel body 41.

The panel body 41 has a pencil-feeding hole 411 aligned with the cutting groove 322, and a plurality of positioning holes 412. The positioning stubs 315 of the outer frame 31 are disposed respectively and removably within the positioning holes 412 for positioning the outer frame 31 and the panel unit 40 relative to each other. The resilient lower retaining hook 43 includes a push portion 431 extending rearwardly from the panel body 41, and a hook portion 432 extending from a bottom side of the push portion 431. The flange 112 of the upper housing 11 is disposed between and abuts against the panel body 41 and the upper retaining hooks 42. The retaining block 113 of the upper housing 11 is clamped between the panel body 41 and the hook portion 432 of the resilient lower retaining hook 43. As such, the panel unit 40 is retained on the housing unit 10.

With particular reference to FIGS. 3 and 4, the shaving-collecting container 50 is disposed removably within the lower housing 12, and extends from the second opening 121 into the cutting space portion 142.

Figure 9:
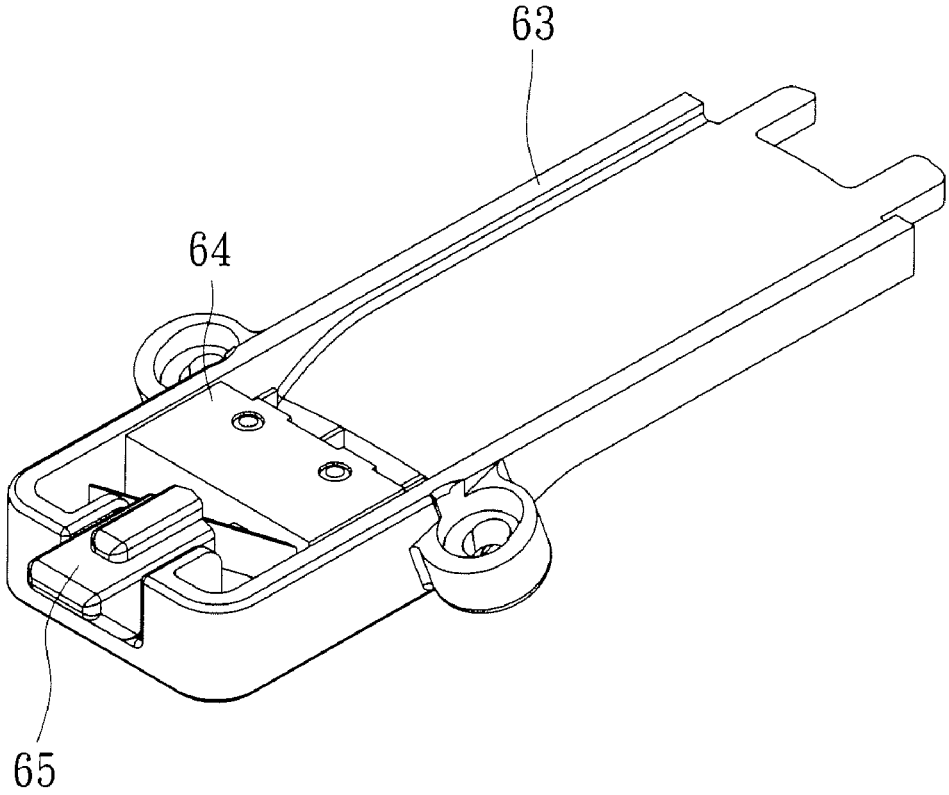
FIG. 9 is a perspective view of a base, a start switch, and a second sliding block of the preferred embodiment.

With further reference to FIG. 9, the activating unit 60 includes a first sliding block 61 disposed movably on the panel body 41 and extending into the pencil-feeding hole 411, a spring 62 disposed between and abutting against the panel body 41 and the first sliding block 61 for biasing the first sliding block 61 to move into the pencil-feeding hole 411, a base 63 disposed on the upper housing 11, a start switch 64 disposed on the base 63 and connected electrically to the driving motor 21, and a second sliding block 65 disposed movably on the base 63. When the first sliding block 61 is pushed and moved by a pencil (not shown) fed into the pencil-feeding hole 411, it pushes the second sliding block 65 to move rearwardly so as to contact and activate the start switch 64, thereby driving the driving motor 21.

With particular reference to FIGS. 3, 4, and 6, when it is desired to assemble the outer frame 31 to the partition 13 via the first opening 111, the positioning blocks 314 are moved respectively into the axial sections 135 of the retaining grooves 134, so that the rear end portion 312 of the outer frame 31 is disposed within the mounting hole 133 and the engagement teeth 323 of the driven portion 321 of the inner frame 32 engage the engagement groove unit 223 in the driving member 22. Subsequently, the outer frame 41 is rotated counterclockwise within the mounting hole 133 so as to move the positioning blocks 314 into the circumferential sections 136, respectively. Consequently, forward removal of the positioning blocks 314 from the retaining grooves 134 is prevented by a plurality of stop plate portions 137 of the loop-shaped walls 132, so that co-rotation of the inner frame 31 with the driving member 22 is allowed, and the cutting unit 30 is positioned within the cutting space portion 142.

With particular reference to FIGS. 3 and 4, to mount the panel unit 40 to the housing unit 10, the upper and lower retaining hooks 42, 43 are inserted into the cutting space portion 142, such that the flange 112 is disposed between the panel body 41 and the upper retaining hooks 42, and the retaining block 113 is clamped between the panel body 41 and the hook portion 432. Hence, the first opening 111 is covered by the panel unit 40, and the positioning stubs 315 engage respectively the positioning holes 412 to facilitate positioning of the cutting unit 30 within the cutting space portion 142.

Figure 10:
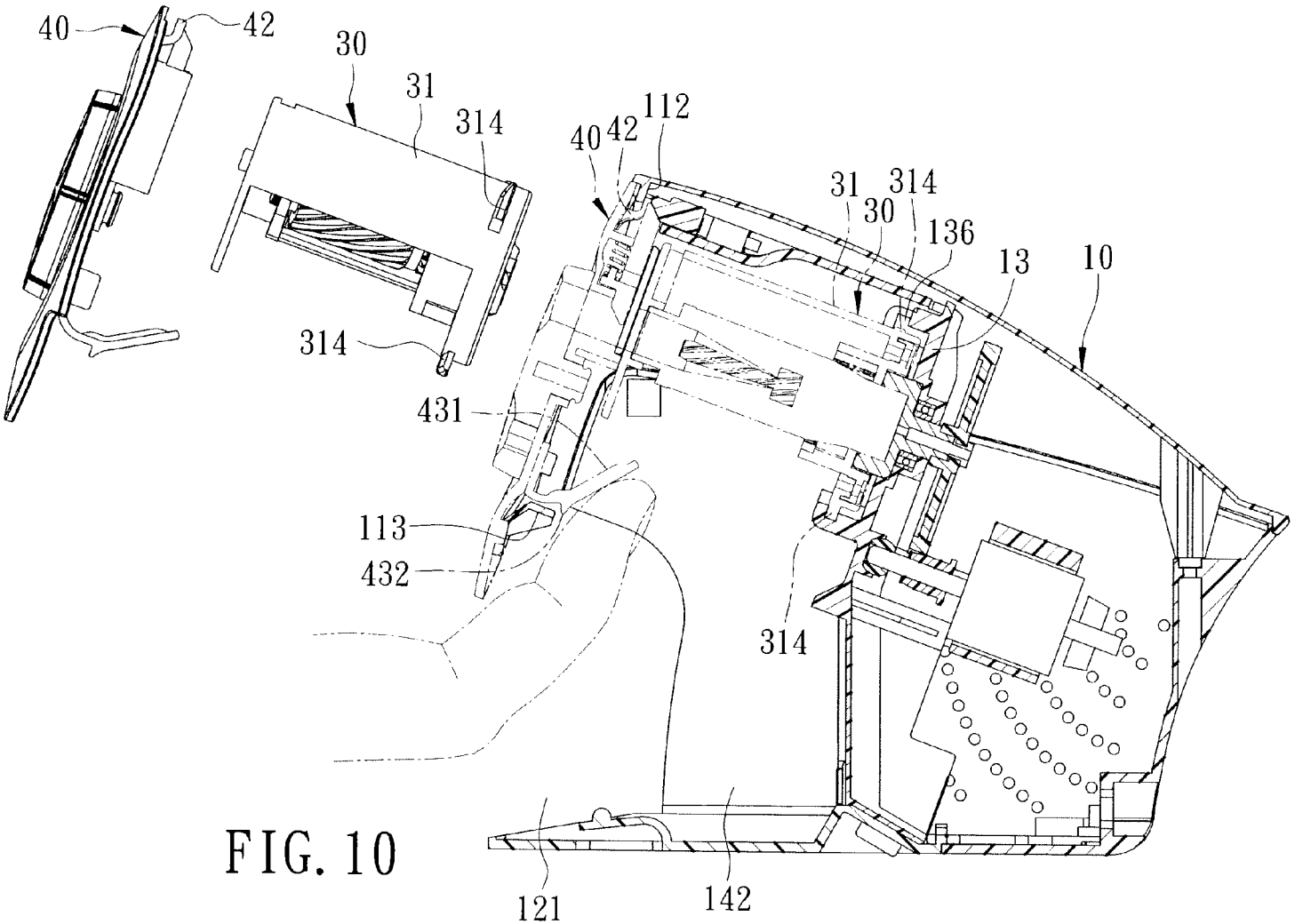
FIG. 10 is a view similar to FIG. 4, illustrating how the panel unit and the cutting unit are removed from a housing unit.

Conversely, with particular reference to FIGS. 3 and 10, to remove the panel unit 40 from the housing 10, the shaving-collecting container 50 is first removed from the housing unit 10. Next, a finger of the user moves into the cutting space portion 142 through the second opening 121, and pushes the push portion 431 upwardly to separate the hook portion 432 from the retaining block 113, thereby allowing for downward removal of the panel unit 40 from the housing unit 10. After removal of the panel unit 40, the first opening 111 is open to allow a hand of the user to move into the housing unit 10 to rotate the outer frame clockwise relative to the partition 13 to thereby disengage the positioning blocks 314 from the circumferential sections 136, respectively. Subsequent to the clockwise rotation of the outer frame 31, the outer frame 31 can be taken out of the partition 13 and, thus, the housing unit 10.

In view of the above, since the cutting unit 30 is mounted removably to the partition 13 of the housing unit 10, and since the panel unit 40 is mounted removably to the upper housing 11 of the housing unit 10, when the blade portions 331 of the cutting members 33 become blunt, the cutting unit 30 can be removed easily and conveniently from the housing unit 10 by the user for replacement of the cutting members 33. Thus, the object of this invention is achieved.

With this invention thus explained, it is apparent that numerous modifications and variations can be made without departing from the scope and spirit of this invention. It is therefore intended that this invention be limited only as indicated by the appended claims.

I claim:

1. An electric pencil sharpener comprising:

a housing unit defining an accommodating space, said housing unit including a partition for dividing said accommodating space into an equipment-receiving space portion and a cutting space portion, and a front end portion formed with a first opening in spatial communication with said cutting space portion;

a driving unit including a driving motor disposed in said equipment-receiving space portion, and a driving member driven by said driving motor;

a cutting unit disposed within said cutting space portion and including an outer frame mounted removably to said partition, an inner frame disposed pivotally within said outer frame, and at least one cutting member disposed pivotally on said inner frame, said outer frame including a ring gear, said inner frame having a driven portion connected co-rotatably and removably to said driving member, and a cutting groove, said cutting member having a blade portion adjacent to said cutting groove, and a planetary gear portion meshing with said ring gear; and a panel unit mounted removably to said housing unit for covering said first opening, said panel unit having a pencil-feeding hole aligned with said cutting groove, wherein, when said panel unit is removed from said housing unit, said cutting unit can be taken out of said housing unit through said first opening;

wherein said partition has a plate body, and a loop-shaped wall disposed on said plate body to define a mounting hole, said loop-shaped wall being formed with a plurality of spaced-apart retaining grooves each having an axial section extending in an axial direction of said mounting hole, and a circumferential section in spatial communication with said axial section and extending in a circumferential direction of said mounting hole, said outer frame of said cutting unit further including a rear end portion disposed within said mounting hole, and a plurality of spaced-apart positioning blocks disposed on an outer periphery of said rear end portion such that, during assembly of said outer frame to said loop-shaped wall of said partition, said positioning blocks are moved respectively into said axial sections of said retaining grooves and subsequently into said circumferential sections by rotating said outer frame within said mounting hole in a direction.

2. The electric pencil sharpener as claimed in claim 1, wherein said driving member of said driving unit is disposed pivotally on said plate body of said partition, and has a driving end extending into said mounting hole, a driven end opposite to said driving end, and an engagement groove unit formed in said driving end, said driven portion of said inner frame of said cutting unit having a plurality of engagement teeth that engage said engagement groove unit so as to allow for co-rotation of said inner frame with said driving member.

3. The electric pencil sharpener as claimed in claim 2, wherein said driving member of said driving unit further has a connecting section connected between said driving end and said driven end, said driving unit further including a ball bearing disposed between said connecting section and said plate body of said partition.

4. The electric pencil sharpener as claimed in claim 3, wherein said driving unit further includes a plurality of reduction gears disposed between said driven end of said driving member and said driving motor.

5. The electric pencil sharpener as claimed in claim 4, wherein said panel unit further has a plurality of positioning holes, said outer frame of said cutting unit further including a plurality of positioning stubs disposed respectively and removably within said positioning holes for positioning said outer frame and said panel unit relative to each other.

6. The electric pencil sharpener as claimed in claim 5, further comprising a shaving-collecting container, said housing unit further including an upper housing and a lower housing disposed under and connected to said upper housing to define said accommodating space therebetween, said first opening being formed in said upper housing, said lower housing having a second opening disposed below said first opening, said shaving-collecting container being disposed removably within said lower housing and extending from said second opening into said cutting space portion.

7. The electric pencil sharpener as claimed in claim 6, wherein said upper housing of said housing unit has a flange extending downwardly from a wall of said upper housing defining a top end of said first opening, and a retaining block disposed at a bottom end of said first opening and extending rearwardly into said cutting space portion, said panel unit further having a panel body, a plurality of upper retaining hooks extending rearwardly and upwardly from said panel body, and a resilient lower retaining hook disposed below said upper retaining hooks and extending rearwardly from said panel body, said flange of said upper housing being disposed between and abutting against said panel body and said upper retaining hooks, said retaining block of said upper housing being clamped between said panel body and said resilient lower retaining hook.

8. The electric pencil sharpener as claimed in claim 7, wherein said resilient lower retaining hook of said panel unit includes a push portion extending rearwardly from said panel body and having a bottom side, and a hook portion extending from said bottom side of said push portion such that said retaining block of said upper housing is clamped between said panel body and said hook portion, thereby retaining said panel unit on said housing unit, said shaving-collecting container being removable from said housing unit to permit extension of a finger of a user into said cutting space portion via said second opening, so that said push portion can be pushed upwardly by the finger to separate said hook portion from said retaining block of said upper housing, thereby allowing for removal of said panel unit from said housing unit.

9. The electric pencil sharpener as claimed in claim 8, further comprising an activating unit, said pencil-feeding hole being formed in said panel body, said activating unit including a first sliding block disposed movably on said panel body and extending into said pencil-feeding hole, a spring disposed between and abutting against said panel body and said first sliding block for biasing said first sliding block to move into said pencil-feeding hole, a base disposed on said upper housing, a start switch disposed on said base and connected electrically to said driving motor, and a second sliding block disposed movably on said base such that, when said first sliding block is pushed and moved by a pencil fed into said pencil-feeding hole, said first sliding block moves said second sliding block to contact and activate said start switch to thereby drive said driving motor.

* * * * *